US005372856A

United States Patent [19]

Ogasawara

[11] Patent Number: 5,372,856

[45] Date of Patent: Dec. 13, 1994

[54] COATING METHOD AND COATING SYSTEM USING VARYING SPEED

[75] Inventor: Toshifumi Ogasawara, Hiroshima, Japan

[73] Assignee: Mazda Motor Corporation, Hiroshima, Japan

[21] Appl. No.: 896,998

[22] Filed: Jun. 11, 1992

[30] Foreign Application Priority Data

Jun. 12, 1991 [JP] Japan ..... 3-140049
Jul. 10, 1991 [JP] Japan ..... 3-169727

[51] Int. Cl.[5] ..... B05D 1/02; B05B 13/04

[52] U.S. Cl. ..... 427/424; 118/323; 118/324

[58] Field of Search ..... 118/323, 324; 427/424

[56] References Cited

U.S. PATENT DOCUMENTS 3,619,311 11/1971 Rose et al. ..... 118/323
4,985,283 1/1991 Ogata et al. ..... 118/323
5,067,436 11/1991 Matsushima et al. ..... 118/323
5,090,361 2/1992 Ishibashi et al. ..... 118/323

FOREIGN PATENT DOCUMENTS 1-297168 11/1989 Japan .

*Primary Examiner*—Shrive Beck
*Assistant Examiner*—Katherine A. Bareford
*Attorney, Agent, or Firm*—Fish & Richardson

[57] ABSTRACT

A coating or spraying gun is so disposed as to be movable back and forth in a given direction of travel of the member to be coated, including a body of an automotive vehicle, and to reciprocate in a direction different from the direction of travel of the member. The reciprocating stroke of the coating gun is altered depending upon the length of the member in the given direction. By altering the speed at which the coating gun moves back and forth in the direction of travel in accordance with the length of the member in the given direction, a pass pitch of the coating gun can be made constant. A coating region of the member is divided into coating sections or blocks in the given direction, and the sections are coated one after another. In this case, the reciprocating track of the coating gun is altered in accordance the radius of curvature of the sections. This arrangement enables a portion of a complex shape, such as a pillar, to be coated by moving the coating gun along the complex shape of the portion.

32 Claims, 7 Drawing Sheets

COATING METHOD AND COATING SYSTEM USING VARYING SPEED

BACKGROUND OF THE INVENTION

1. Field of the Invention

The present invention relates to a coating method and a coating system and, more particularly, to a coating method and a coating system for coating a member, being conveyed, with a coating gun reciprocating in a predetermined direction.

2. Description of the Related Art

It is known that the member being conveyed is coated with a coating gun which reciprocates in a predetermined direction, i.e. in the direction perpendicular to the direction of conveyance of the member to be coated.

For example, when a side portion of the body of an automotive vehicle conveyed into the coating station in a coating line is coated, the coating gun usually reciprocates in a vertical direction with respect to the side portion of the body.

For example Japanese Patent Laid-open Publication (kokai) 1-297,168 discloses a coating method and a coating system. In this prior technology, the side portion of the body is divided into plural sections in the vertical direction and the coating guns are disposed so as to correspond to the plural sections of the side portion. Each of the coating guns is arranged to reciprocate in a vertical direction within the length defined by the divided sections of the side portion of the body, thereby reducing the amount of displacement of each of the coating guns to a considerable extent and speeding up the coating operation in the coating line with improved efficiency in the coating operation.

It can be noted, however, that the prior technology requires a plurality of the coating guns and that the displacement or movement of the coating gun and the operation of spraying a paint should be separately controlled. Thus, the prior technology suffers from the disadvantages that the system itself becomes larger in size and the structure and configuration of the coating system becomes more complex so that a wide space for installation is required and costs of equipment become more expensive.

On the other hand, Japanese Utility Model Laid-open Publication (kokai) No. 62-151,970 proposes a compact system that requires only one coating gun for coating a whole side portion of the body. In this system, a guide rail is disposed so as to guide the coating gun vertically along and parallel to a curved shape of the side portion of the body. Further, this is provided with a tilt mechanism at a portion supporting the coating gun so as to tilt the coating gun at a given angle of spraying a paint toward the curved side of the member in a distance away from the surface of the curved side portion.

It is to be noted, however, that when the paint is sprayed with a spraying gun, the thickness of a coat formed by one spraying operation on the surface of the member to be coated is not constant in the widthwise direction of a sectional pattern of the coat. Specifically, the middle portion of the sectional pattern becomes thicker than both side portions.

Thus, in order to provide a coating with a uniform coat thickness and of Good quality, it is desired that a distance between two passes, that is, a pass pitch, be restricted to a value smaller than a predetermined value with respect to the width of the pattern and that the paint is coated with one pattern of a coat overlapping partially with the pattern of another coat that follows.

In other words, it is desired to ensure a constant number of applications of the paint to the side portion of the member to be coated and to hold the number of applications constant over the entire area of the surface of the member to be coated.

It can be noted that the side portion of the body is composed of side panels which are different in vertical height. More specifically, the side portion of the body comprises a front portion (a front fender side section), a middle portion (a compartment side section), and a rear portion (a rear fender side section), and these three side panel sections have different vertical lengths.

When the side portion consisting of those different side panel sections is coated with one coating or spraying gun, a conventional technique is such that a reciprocating stroke of the coating gun is held constant, regardless of the different vertical lengths among the side sections of the vehicle. Specifically, the reciprocating stroke of the coating gun is adapted to the vertically longest compartment side section and the paint is coated on the compartment side section and the spraying of the paint is partially ceased, while the stroke operation only is still in process, thereby failing to coat the portions before and behind the compartment side section as well as above the front and rear fender side sections. Alternatively, the reciprocating stroke of the coating gun is adapted to either of the front fender side section or the rear fender side section and the portions outside the reach of the reciprocating stroke of the coating gun are coated separately.

It can be noted, however, that the former carries out the stroke operation at the portions where no paint is sprayed, on the one hand, thereby reducing the efficiency in the coating operation, and that the latter requires a separate coating process for the portions outside the reach of the reciprocating stroke of the coating gun, on the other hand, thereby impairing improvements in production.

SUMMARY OF THE INVENTION

The present invention has the object to provide a coating method and a coating system so adapted as to improve the working efficiency in the coating step by requiring no useless stroke operation of a coating gun.

Another object of the present invention is to provide a coating method and a coating system so adapted as to ensure a good coating having a uniform coat thickness and to improve the working efficiency in the coating step.

In order to achieve the aforesaid objects, the present invention is basically constructed by the coating method for coating a member being conveyed with a coating gun arranged so as to reciprocate in a predetermined direction different from a direction of conveyance of the member to be coated, which is characterized by:

coating said member by altering a reciprocating stroke of said coating gun in accordance with a length of the member extending in said predetermined direction; wherein said coating gun is so disposed as to be reciprocating in said predetermined direction and as to be movable back and forth in said direction of conveyance.

This arrangement for the coating method according to the present invention can minimize the movement of the reciprocating stroke of the coating gun in the predetermined direction, thereby improving the working efficiency in the coating step.

Further, a uniformly thick coating of high quality can be provided over the entire area of the side portion of the body by altering a speed of the back-and-forth movement of the coating gun in the direction of conveyance of the members to be coated and making pass pitches of the patterns of coats constant over the entire coating region of the side portion of the member. In this case, it is preferred to hold constant a tip-end speed of the coating gun and an amount of a paint to be sprayed in order to prevent the quality of a coating from deteriorating due to a variation in the tip-end speed and the amount of the paint to be sprayed.

It is also feasible to divide the coating area of the member into plural sections or blocks in a predetermined direction, i.e. in the reciprocating direction of the coating gun, and the paint is coated on the divided sections or blocks one after another. In this case, the reciprocating stroke of the coating gun is arranged or changed so as to be adapted to the length of each of the divided sections or blocks in the predetermined direction.

When the coating region is divided into the plural sections or blocks, it is preferred to alter the track or locus formed by the reciprocating movement of the coating gun in accordance with a radius of curvature in each of the divided sections or blocks.

Further, it is preferred to transfer the coating gun so as to follow a shape of the member to be coated when the member to be coated is complex in shape. For example, when a curved portion of the body of an automotive vehicle having a narrow width, such as a pillar section, is partially provided, it is efficient to coat the pillar section with the coating gun so arranged as to follow the complex shape of the member.

On the other hand, the coating system according to the present invention has the following features.

The arrangement for the coating system as described can give a uniformly thick coating of high quality as well as improve the working efficiency in the coating step.

Further, the coating system as described can provide a coating having a uniform coat thickness and high quality and improve the working efficiency in the coating step even if the coating sections or blocks have different radii of curvature.

In addition, the coating system as described can serve as further improving the working efficiency in the coating step.

Other objects, features and advantages of the present invention will become apparent in the course of the description of the preferred embodiments which follows, with reference to the accompanying drawings.

DESCRIPTION OF THE PREFERRED EMBODIMENTS

The present invention will be described more in detail with reference to the accompanying drawings on the embodiments in which the present invention is applied to the side portion of the body of an automotive vehicle.

Coating System

Figure 1:
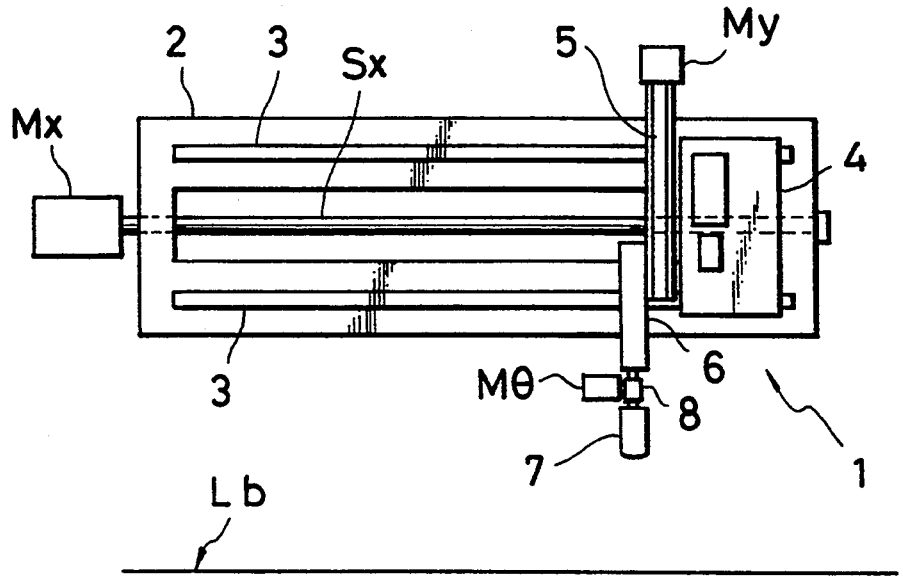
FIG. 1 is a plan view showing an example of a coating system according to the present invention.
Figure 2:
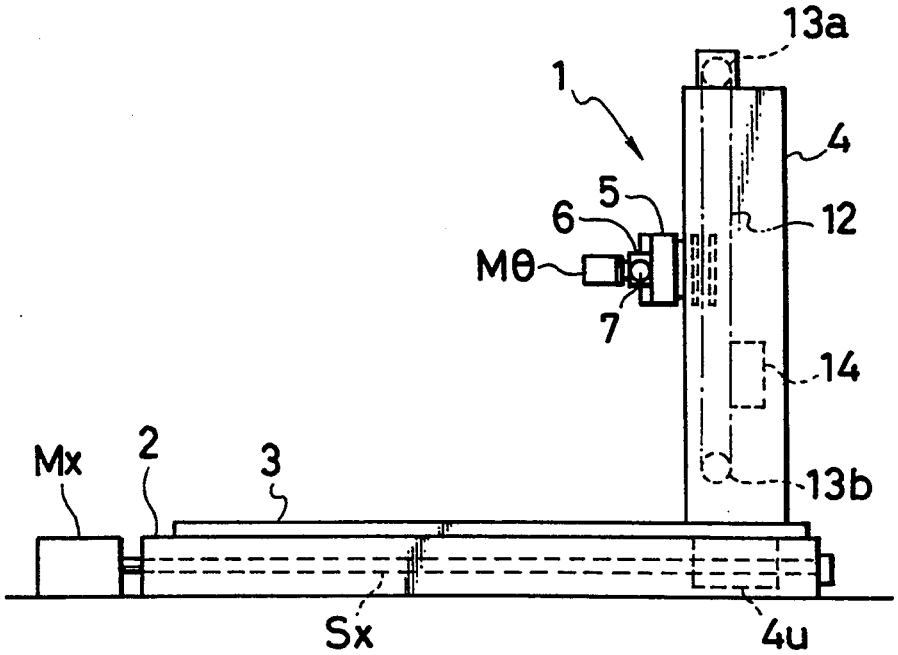
FIG. 2 is a front view showing the coating system of FIG. 1.
Figure 3:
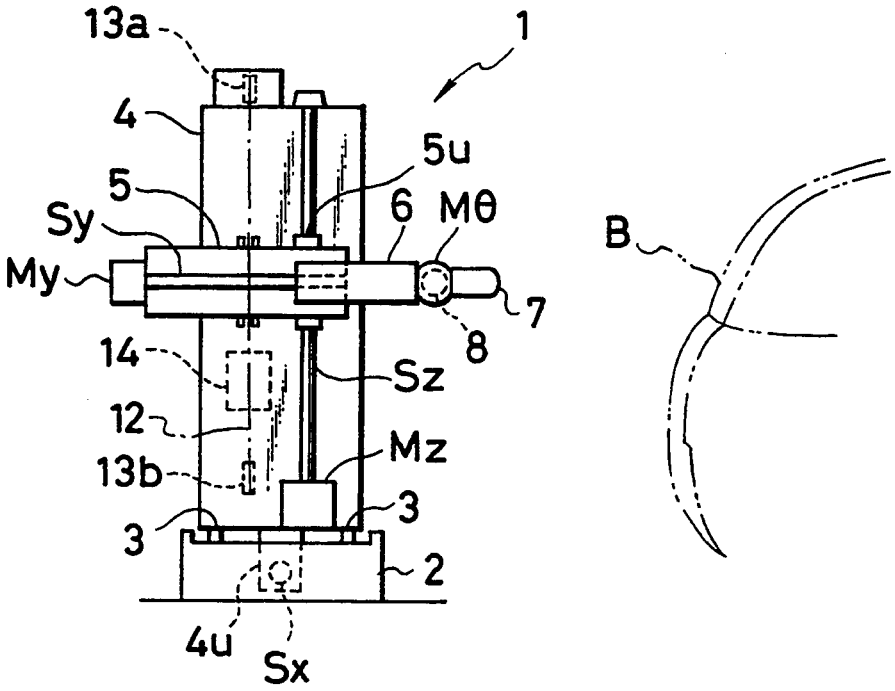
FIG. 3 is a side view showing the coating system of FIG. 1.
Figure 4:
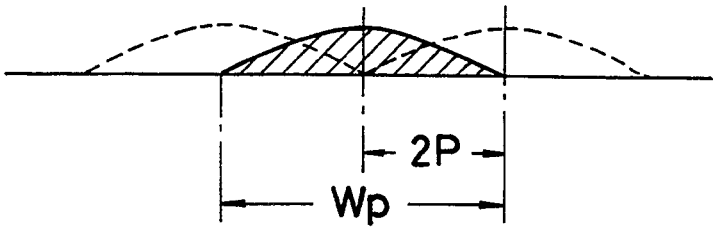
FIG. 4 is a longitudinally sectional view showing a coat thickness of a pattern of a coat in the widthwise direction, formed on the surface of a member to be coated.

As shown in FIGS. 1, a coating apparatus 1 is disposed on a base 2 and the coating apparatus 1 comprises two parallel rails 3, 3 extending along and parallel to a line Lb for conveying bodies, a rectangular coating machine 4 disposed on the rails 3, 3, an arm support unit 5 supported by the coating machine 4 and directed toward the direction perpendicular to the line Lb (the direction being referred to hereinafter as "lateral direction") on a horizontal plane, a coating arm 6 mounted to the arm support unit 5 and extending to the side of the line Lb, and a coating gun 7 mounted on a top end of the coating arm 6.

Between the two rails 3, 3 is interposed a horizontal driving shaft Sx comprised of ball screws, extending parallel to the rails 3, 3, one end of which is connected to an output side of an electric motor Mx for driving the rotation of the horizontal driving shaft Sx.

At the bottom portion of the coating machine 4 is secured a box-shaped mounting unit **4*u* so as to be engaged or associated with the horizontal driving shaft Sx, and the coating machine 4 is driven and moves by the aid of the mounting unit 4*u* by driving the electric motor Mx and rotating the horizontal driving shaft Sx. It can be noted that the direction of movement of the coating machine 4** can be reversed by changing the direction of rotation of the horizontal drive shaft Sx.

The coating machine 4 is guided by the electric motor Mx along the parallel rails 3, 3 and moved back and forth in the direction of conveyance along and parallel to the line Lb.

On the side portion of the coating machine 4 is disposed a vertical driving shaft Sz comprised of ball screws, a bottom end of which is connected to an output side of an electric motor Mz secured to the lower portion of the coating machine 4 for driving the vertical driving shaft Sz.

The arm support unit 5 is mounted in the direction perpendicular to the vertical driving shaft Sz with the aid of a mounting unit 5*u* and directed toward the lateral direction. The arm support unit 5 is moved in a vertically reciprocating way along and parallel to the vertical driving shaft Sz by driving the electric motor Mz and rotating the vertical driving shaft Sz.

Inside the coating machine 4 and between upper and lower sprockets 13*a*, 13*b* is disposed a chain 12, with a balance weight mounted thereto, for lifting or lowering the arm support unit 5. The rear side of the arm support unit 5 is secured at an appropriate position of the chain 12.

On the side portion of the arm support unit 5 is disposed a lateral driving shaft Sy comprised of ball screws and extending in the lateral direction on a horizontal plane, a rear end portion of which is connected to an electric motor My secured to the rear end of the arm support unit 5 for driving the lateral driving shaft Sy.

The coating arm 6 is mounted in the same direction as the arm support unit 5 and is moved in the lateral direction on a horizontal plane along or parallel to the lateral driving shaft Sy by driving the electric motor My and rotating the lateral driving shaft Sy, thereby allowing adjustment of the lateral position of the coating arm 6.

At a top end portion of the coating arm 6 is mounted the coating gun 7 through a tilt mechanism 8 which is arranged to tilt the coating gun 7 in a vertical direction on a vertical plane by driving an electric motor M$\theta$ attached to the tilt mechanism 8, thereby allowing a tip of the coating gun 7 to be directed to a predetermined oblique direction.

Ball screw mechanism for moving the coating machine 4, the coating arm 6 and the arm support unit 5 in the axial direction by rotating the horizontal driving shaft Sx, vertical driving shaft Sz and lateral driving shaft Sy, respectively, through the ball screws, and the tilt mechanism 8 for tilting the coating gun 7 by driving the electric motor M$\theta$ are conventionally known so that an illustration and a detailed description of those mechanisms will be omitted from the specification.

The coating gun 7 can be mounted to the coating arm 6 so as to be rotatable about a longitudinal axis of the vertical driving shaft Sz in order to be directed toward various directions, so that the coating gun 7 can be transferred via a so-called robot operation as well as a vertical tilt operation along the shape of the site at which the member or substrate is coated.

Figure 15:
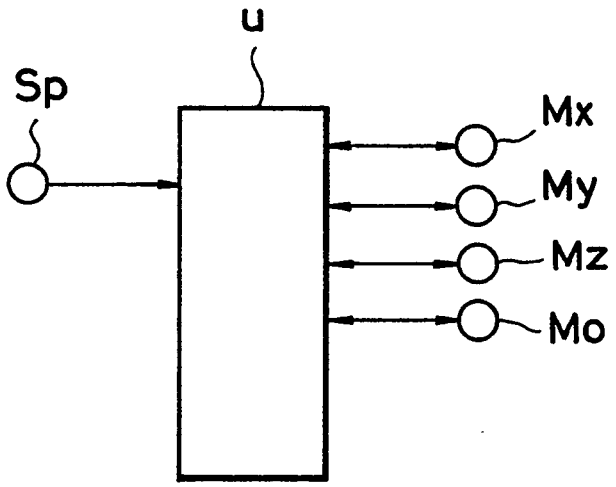
FIG. 15 is a block view showing a control system.

As shown in FIG. 15, the coating apparatus 1 is provided with a controller U comprising of, for example, a microcomputer as a major constituent. Each of the electric motors Mx, My, Mz and M$\theta$ may comprise, for example, an AC servo motor, which in turn is connected so as to generate and receive a signal to and from the controller U.

The controller U generates control signals for driving or suspending the servo motors Mx, My, Mz and M$\theta$ as well as for adjusting the speed of rotation and the direction of rotation. For this control, the controller U is provided with a signal indicative of a position (a position of conveyance) of the body B as a member to be coated.

With the arrangement as described hereinabove, the coating apparatus 1 starts operating as the body B enters into the coating station, and each of the servo motors Mx, My, Mz and M$\theta$ is driven. The body B is continued to be conveyed at a predetermined speed of a conveyor (at a constant speed) in and along the direction of conveyance, while the coating apparatus 1 controls the arm support unit 5 so as to reciprocate in the vertical direction and the lateral position of the coating arm 6 and a tilt angle of the coating gun 7 so as to be adapted to a curved shape of the side portion of the body B.

The coating machine 4 is concurrently moved back and forth in the direction of conveyance of the body. Specifically, the coating machine 4 is moved back and forth along or in the direction of conveyance of the body—it conducts a tracking operation—at a relative speed with respect to the conveyor speed in the line Lb so as to make a pass pitch always constant as will be described hereinafter.

Coating Method

Figure 5:
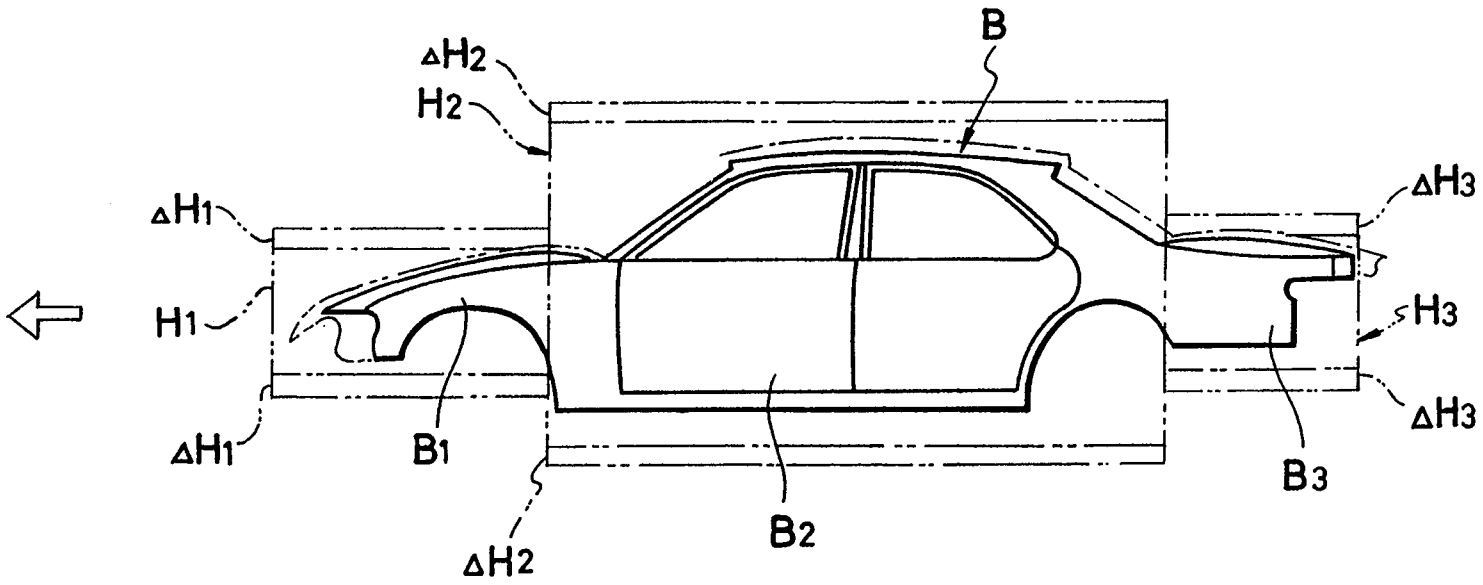
FIG. 5 is a side view showing a side portion of the body of an automotive vehicle.

As shown in FIG. 5, this embodiment according to the present invention can avoid a useless movement of the coating gun 7 and shorten the coating time by changing the vertically reciprocating strokes of the coating gun 7 in accordance with the vertical lengths of the side sections of the body: for example, a front fender side section B1 at the front portion of the body; a compartment side section B2 at the middle portion thereof; and a rear fender side section B3 at the rear portion thereof.

In this case, as shown in FIG. 5, the vertically reciprocating movement of the coating gun 7 is not required at the portions above the upper portion and below the lower portion of the front fender side section B1 and the rear fender side section B3. More specifically, the coating gun 7 is arranged not to reciprocate vertically at the portions above and below the range H1 and before the range H2 as well as above and below the range H3 and behind the range H2.

Hence, the vertically reciprocating movement of the coating gun is required at the portions as defined by reference symbols H1, H2 and H3 corresponding to the vertical lengths of the front fender side section B1, the compartment side section B2, and the rear fender side section B3 of the body B, respectively. This arrangement can improve the coating efficiency.

As shown in FIG. 5, each of the vertical ranges H1, H2 and H3 is provided at its upper and lower ends with a vertically marginal range $\Delta$H1, $\Delta$H2, and $\Delta$H3, respectively, for allowing the coating gun 7 to reduce or accelerate the speed of the vertically reciprocating movement and to make a return at the position above or below the upper or lower ends.

Further, in this case, in order to maintain the number of applications of the paint constant over the entire area of the side portion of the body B, the relative speed of the coating machine 4, i.e. the coating gun 7, with respect to the body B in the direction of conveyance is controlled to become an optimal value preset for each of the front fender side section B1, the compartment side section B2, and the rear fender side section B3, when the paint is coated on the front fender side section B1, the compartment side section B2, and the rear fender side section B3.

A description will now be made of the way of setting the relative speed of the coating gun 7 with reference to the specific embodiments. The track or locus of the coating gun 7 is determined as it reciprocates in the vertical direction and the reciprocating stroke is computed for each of the front fender side section B1, the compartment side section B2, and the rear fender side section B3.

Figure 6:
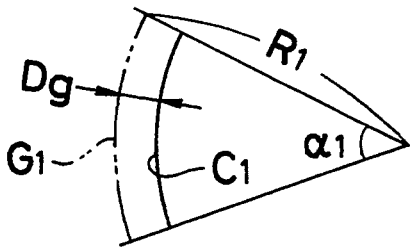
FIG. 6 is a schematic representation showing an appropriate curve of the front fender side section of the body and a track or locus of the coating gun.
Figure 7:
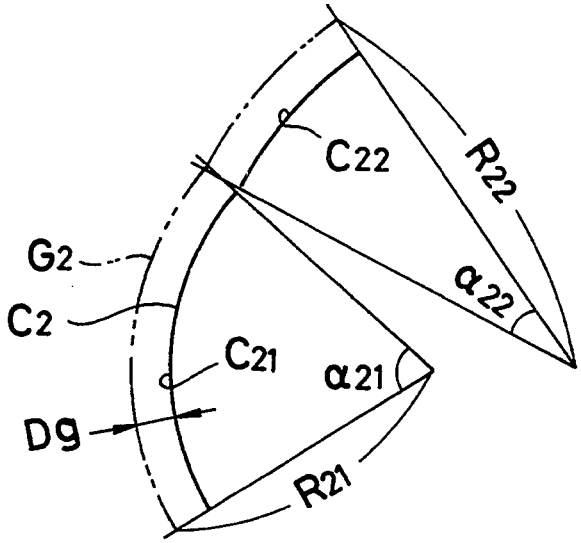
FIG. 7 is a schematic representation showing an appropriate curve of the compartment side section of the body and a track or locus of the coating gun.
Figure 8:
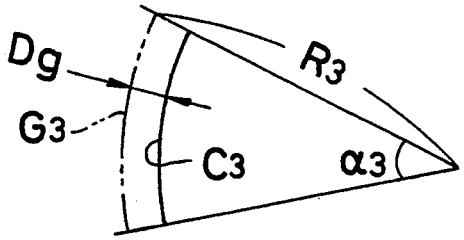
FIG. 8 is a schematic representation showing an appropriate curve of the rear fender side section of the body and a track or locus of the coating gun.

More specifically, as shown in FIGS. 6, 7 and 8, the curves forming the outer surfaces of the side sections (i.e. the front fender side section B1, the compartment side section B2, and the rear fender side section B3) of the side portion of the body B approximate to curves C1, C2 and respectively, formed by a single arc or a combination of plural arcs. Then, the tracks or loci G1, G2 and G3 of the vertically reciprocating movements of the coating gun 7 along and parallel to their surfaces for the front fender side section B1, the compartment side section B2, and the rear fender side section B3 by appropriately setting a distance, i.e. a coating distance, between the tip of the coating gun 7 and the corresponding surface of the side portion of the body B from coating conditions.

It is to be noted herein that each of the tracks or loci G1, G2 and G3 is synthesized from the lifting and lowering operation of the arm support unit 5, the 1 movement of the coating arm 6, and the vertically tilting operation of the coating gun 7. In this embodiment, for the front fender side section B1 and the rear fender side section B3, respectively, the single arcs C1 and C3 approximate the portions extending along and parallel to the arcs C1 and having radii R1 and R3 and central angles $\alpha 1$ and $\alpha 3$; for the compartment side section B2, respectively, a combination of the two arcs C21 and C22 approximates to the portions extending along and parallel to the arcs C21 and C22 and having radii R21 and R22 and central angles $\alpha 21$ and $\alpha 22$.

For the automotive vehicle employed for the present invention, the radii R1, R21, R22 and R3 as well as the central angles $\alpha 1$, $\alpha 21$, $\alpha 22$ and $\alpha 3$ of the tracks or loci G1, G2 and G3 of the coating gun 7 are as shown in Table 1 below. Based on those values, the vertical length L of the reciprocating track or locus (in the form of an arc-like curve) of the coating gun 7 is computed for each of the front fender side section B1, the compartment side section B2, and the rear fender side section B3, respectively, when the coating gun 7 reciprocates vertically along each of the tracks or loci G1, G2 and G3.

In order to keep a sufficiently uniform coat thickness of a coating formed on the body B, while being conveyed, by the vertically reciprocating movement of the coating gun 7 at different vertical strokes, it is necessary to have a coat formed by one pass partially overlap with another coat formed by one pass in the immediately previous coating operation.

In this embodiment, a half of the width Wp of a pattern of a coat is set so as to overlap with a half of a pattern of another coat which was formed immediately beforehand. Hence, one pass of the vertically reciprocating coating gun 7, i.e. a pass pitch P, is set to a quarter of the width Wp of the pattern of the coat.

It is noted herein that in this embodiment the width Wp of the coat pattern is set to 300 mm. Hence, the pass pitch P is set to 75 cm (see Table 1 below).

It can be noted that the relationship among the amount of the paint to be sprayed, Q, the relative speed Vr of the coating gun 7 in the direction of conveyance of the body with respect to the member to be coated, and the coat thickness t can be represented by the formula (1) below. The predetermined coat thickness t can be given by adjusting the amount Q of the paint to be sprayed by controlling a pump unit (not shown) of the coating apparatus 1 or by adjusting the relative speed Vr by controlling the number of revolutions of the electric motor Mx for rotating the horizontal driving shaft Sx and the direction of rotation.

In this embodiment, the amount Q of the paint to be sprayed is set constant in the formula (1) below in order to prevent an atomizing state of the paint from varying and to provide a coating of stable quality.

The formula (1) can be represented by the following formula:

$$Q = Vr \times Lg \times t \times \rho_1 \times \frac{\frac{(R - Dg)}{R}}{(\rho_2 \times NV \times \eta)}$$

where

Lg is the stroke length of the coating gun;

P1 is the specific gravity of the coat (a constant to be determined by the physical properties of the paint);

P2 is the specific gravity of the liquid of a paint (a constant to be determined by the physical properties of the paint);

$\eta$ is the efficiency (a constant to be determined by the coating apparatus);

R is the radius of curvature of the reciprocating movement of the coating gun; and Dg is the coating distance.

It is to be noted herein that the stroke length Lg of the coating Gun 7 is the sum of the vertical length L of the track or locus (in the form of an arch-like curve) formed by the reciprocating movement of the coating Gun 7 plus the length corresponding to each of the vertical length of the respective marginal ranges required for increasing or reducing the reciprocating movement of the coating gun 7 at the time of returning at each of the upper and lower end portions. The stroke length Lg can be computed by the formula (2) as follows:

$$Lg = L + \frac{Ta}{Vg} = Tp \times Vg$$

where

Vg is the tip-end speed of the coating gun at the time of a stroke operation;

Ta is the time required for an increase or a decrease in the reciprocating movement at the time of a return at the upper end portion and at the lower end portion; and Tp is the time required for one pass.

In this embodiment, the tip-end speed Vg of the coating gun 7 is set to 60 meters per minute as a speed at the highest level within the range that can ensure the coating efficiency to an extent larger than a predetermined level. Further, the time required for acceleration or deceleration is set to 0.3 second.

The relative speed Vr can be computed from the formula (3) below because there is the relationship among the relative speed Vr, the pass pitch P, and the time required for one pass. The formula (3) can be represented as follows:

$$\frac{P}{Vr} = \frac{L}{Vg} + Ta = Tp$$

The computation results of the relative speed Vr for the front fender side section B1, the compartment side section B2, and the rear fender side section B3 of the body B are shown in Table 1 below.

In this embodiment, the lengths in the direction of conveyance for each section of the side portion of the body B are as follows: 1.4 meters for the front fender side section B1; 2.9 meters for the compartment side section B2; and 0.8 meter for the rear fender side section B3. From these values and the relative speeds at the front fender side section B1, the compartment side section B2, and the rear fender side section B3, the time required for coating one body can be computed as 1.84 minutes.

Further, the amount of the paint to be sprayed, Q, can be computed by the formula (4) as follows:

$$Q = Vr \times Lg \times A = Tp \times Vg \times A$$

where A is a constant.

TABLE 1

| Coating Site & Track of Gun | Radius & Central Angle | Length of Track, L (mm) | Tip End Speed, Vg (m/min) | Pass Pitch, p (mm) | Time for One Pass, Tp (sec) | Relative Speed, Vr (m/min) | Coating Time (min) | Amount of Paint, Q (× A) |
|---|---|---|---|---|---|---|---|---|
| Front Fender & Track G1 | R1 = 1000<br>α1 = 45° | 785 | 60 | 75 | 1.08 | 4.17 | 0.34 | 4.50 |
| Compart-ment & Track G2 | R21 = 1050<br>α21 = 56°<br>R22 = 1500<br>α22 = 27° | 1730 | | | 2.03 | 2.22 | 1.31 | |
| Rear Fender & Track G3 | R3 = 1200<br>α = 38° | 795 | | | 1.10 | 4.09 | 0.19 | |

EXPERIMENT EXAMPLES

In Experiment Example 1, the coating was carried out in the same manner as shown in Table 1 above.

In Experiment Examples 2, 3 and 4, the vertically reciprocating strokes of the coating gun were not changed and the coating gun was moved in a vertically reciprocating way along the track or locus G2 for the compartment side section B2 to thereby coat the whole surface of the side portion of the body B. In Experiment Example 2, the tip-end speed of the coating gun, the pass pitch and the amount of the paint to be sprayed were set to the same as in Experiment Example 1; in Experiment Example 3, the pass pitch and the period of time required for one pass were set to the same as in Experiment Example 1; and in Experiment Example 4, the tip-end speed of the coating gun and the period of time required for coating one body were set to the same as in Experiment Example 1.

In Experiment Examples 5 and 6, the vertically reciprocating strokes of the coating gun were controlled in substantially the same manner as in Experiment Example 1 so as to be variable in accordance with the sites of the body to be coated. Hence, the front fender side section B1, the compartment side section B2, and the rear fender side section B3 were coated with a paint by vertically reciprocating movement of the coating gun along the respective tracks and loci G1, G2 and G3. In Experiment Example 5, the pass pitch and the period of time required for coating one body were set to the same as in Experiment Example 1; in Experiment Example 6, the tip-end speed of the coating gun and the period of time required for coating one body were set to the same as in Experiment Example 1.

In Experiment Example 7, the vertically reciprocating strokes of the coating gun were not controlled without variable control and the side sections of the body B was coated by vertically reciprocating movement of the coating gun along the track or locus G3 for the rear fender side section B3. Hence, this process requires the additional and separate coating to be implemented for coating the rest of the side sections. In this Experiment Example, however, the pass pitch and the period of time required for coating one body were set to the same as in Experiment Example 1.

TABLE 2

| No. of Exper-iment Example | Features of Coating Process | Tip End Speed (m/min) | Pass Pitch (mm) | Amount of Paint (× A) | Time (min) | Evaluation Items A | B | C | D | E | F |
|---|---|---|---|---|---|---|---|---|---|---|---|
| 1 | Table 1 | 60 | 75 | 4.50 | 1.84 | ○ | ○ | ○ | ○ | ○ | ○ |
| 2 | Overall | 60 | 75 | 4.50 | 2.31 | ○ | ○ | ○ | ○ | ○ | x |
| 3 | Coating | 78.6 | | 5.88 | 1.84 | ○ | x | ○ | x | ○ | ○ |
| 4 | along Track G2 | 60 | 94 | | | ○ | ○ | x | x | ○ | ○ |
| 5 | Recipro-cating Strokes | 35.7<br>78.6<br>36.1 | 75 | 2.67<br>5.88<br>2.70 | 1.84 | ○ | x | ○ | x | x | ○ |
| 6 | along Tracks G1, G2 & G3 (without Track- | 60 | 50<br>94<br>51 | 3.00<br>5.62<br>3.03 | 1.84 | ○ | ○ | x | x | x | ○ |

TABLE 2-continued

| No. of Experiment Example | Features of Coating Process | Tip End Speed (m/min) | Pass Pitch (mm) | Amount of Paint (× A) | Time (min) | Evaluation Items A | B | C | D | E | F |
|---|---|---|---|---|---|---|---|---|---|---|---|
| | ing) | | | | | | | | | | |
| 7 | Partial Coating | 54 | 75 | 4.05 | 1.84 | x | ○ | ○ | ○ | ○ | ○ |

In the Table 2 above, when the evaluation results were satisfactory, the evaluation items are indicated by a circle (O), while when the evaluation results were not satisfactory, the items are indicated by an X-mark (X). The evaluation items include: item A for evaluation as to whether the coating can be implemented over the entire side surfaces without any additional coating process; item B for evaluation as to whether the tip-end portion of the coating gun is controlled to an appropriate extent because the coating efficiency becomes lower and excessive-load is imposed upon a mechanical drive mechanism for the reciprocating movement of the coating gun to thereby shorten the reliability of the system, when the tip-end speed thereof is too fast; item C for evaluation as to whether a condition of the pass pitch is appropriate (the pass pitch being conveniently set to a quarter of the pattern of the coat in order to ensure the uniformity in a coating; item D for evaluation as to whether the amount of the paint to be sprayed is appropriate; item E for evaluation as to whether there is a variation in the amount of the paint to be sprayed; and item F for evaluation as to whether the period of time required for coating one body is appropriate. In evaluation item D, the better results can be given in a smaller amount of the paint; in evaluation E, the evaluation result is rated as satisfactory when there is no variation; and in evaluation F, the better results can be produced by a shorter coating time.

The Experiment Examples 1, 5 and 6 according to the embodiments of the present invention found it useful to achieve the improvements in working efficiency of the coating step by shortening the period of time required for coating, decreasing the amount of the paint to be employed, and reducing costs of coating.

More specifically, the Experiment Example 1 demonstrates the preferred embodiment in which the tip-end speed of the coating or spraying gun and the amount of the paint to be sprayed are always sustained at constant levels so that it can provide an extremely stable coating of high quality. Further, in the Experiment Example 1, the pass pitch can be held always constant so that a coating with a uniform thickness can be produced over the entire area of the member to be coated, thereby providing a coating of extremely high quality.

Further, the Experiment Example 5 can be said to be somewhat less in quality than that obtained in the Experiment Example 1 because the tip-end speed of the coating or spraying gun and the amount of the paint to be sprayed vary to somewhat extent; however, this Experiment Example can provide a coating that is practically applicable because it can provide a coating of sufficiently high quality on the basis of a constant pass pitch.

In addition, the Experiment Example 6 provides a coating that is less in high quality of a coating than each of those obtained in the Experiment Examples 1 and 5 because particularly the pass pitch varies, too, in addition to the amount of the paint to be sprayed. It can be noted, however, that the quality of the coating itself can satisfy the extent to which it is commercially expected to meet the requirements.

On the other hand, the Experiment Example 2 requires a longer period of time required for coating so that this embodiment cannot be said to be satisfactory in terms of the requirement for improvements in the working efficiency in the coating step. Further, the Experiment Examples 2 and 3 require a larger amount of the paint so that they are so expensive and less satisfactory in terms of the working efficiency in the coating step. In addition, the Experiment Example 7 does require an additional coating for coating the portion that cannot be coated by the first coating operation, so that this operation is least satisfactory in terms of improvements in the working efficiency of the coating processes, although this procedure can provide a coating of sufficiently high quality.

First Variant of Coating Method

Figure 9:
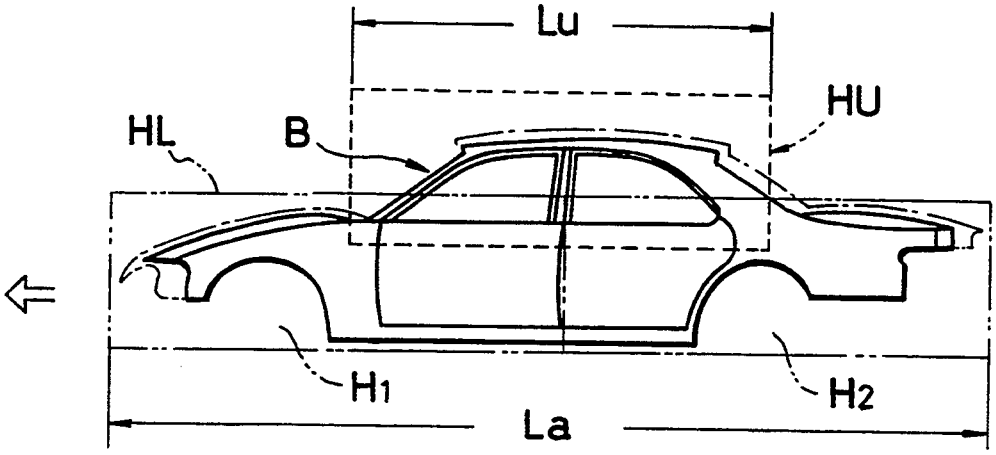
FIG. 9 is a side view showing coating sections or blocks divided from the side portion of the body.

As shown in FIG. 9, the side portion of the body B to be coated is divided into an upper side section, as indicated by reference symbol HU, and a lower side section, as indicated by reference symbol HL. Further, the lower side section HL is divided into two lower subsections, as indicated by reference symbols H1 and H2. In this embodiment, the coating is carried out first on the first lower subsection H1, then on the upper section HU, and finally on the second lower subsection H2.

More specifically, the lower subsection H1 of the side portion of the body B is coated and then the coating machine 4 of the coating apparatus 1 is transferred to the downstream side in the direction of conveyance of the bodies of the automotive vehicles, thereby transferring the coating or spraying gun 7 to the upper section HU. After the completion of the coating on the upper section HU, then the coating machine 4 is tracked to thereby move the coating gun 7 toward the lower side subsection H2, followed by the application of a paint to the lower side subsection It can be noted herein that, by applying the paint to the divided side sections H1, HU and H2 of the body B one section after another in this order over the entire range of the side portion thereof, the coating can be effected along the surfaces of the sections H1, HU, and H2 of the side portion by only one coating or spraying gun 7 to thereby provide a coating having uniform thickness over the entire are of the coating with high efficiency.

More specifically, the side panels of the body B to be coated can be coated in accordance with the curved surface shape of the side panels by dividing the side panels into sections or blocks, e.g. an upper section HU and a lower section HL, in the direction in which the coating or spraying gun 7 is reciprocating vertically.

It should be noted that the arrangement for this coating operation does not require the coating gun 7 to be vertically moved at the portion that is not required to be coated, e.g. the forward portion in front of the front end of the upper section HU and the rearward portion behind the rear end thereof, so that the entire area of the side portion of the body B can be coated without any useless movement of the coating gun 7, whereby the working efficiency can be improved.

Further, it can be noted that the division of the range or area to be coated can make smaller an amount of tracking the coating machine 4 for coating the divided sections one section after another, thereby serving as making the coating system compact and small in size as a whole.

A specific description will now be made of the conditions of coating the sections or divisions, e.g. H1, HU and H2.

First, the tracks or loci for the upper section HU and the lower section HL are given in moving the coating or spraying gun 7 in a reciprocating fashion and then the reciprocating stroke is computed.

Figure 10:
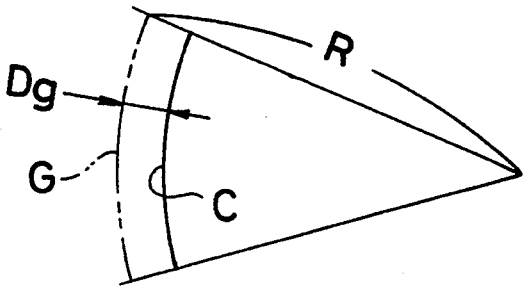
FIG. 10 is a schematic representation showing an appropriate curve of the curved surface at the upper half section and the lower half section of the body and a track or locus of the coating gun.

In this embodiment, as shown in FIG. 10, the curved lines forming the outer surfaces of the upper and lower side sections HU and HL of the body B approximate, for example, to an arc C having the same radius R from a different center of the arc C.

Thereafter, the vertically reciprocating track or locus G of the coating gun 7 along each of the surfaces of the side sections is given for each of the upper side section HU and the lower side section HL by appropriately setting the length or distance, i.e. a coating distance Dg, between the tip-end of the coating gun 7 and the surface of the side portion of the body B.

Like the embodiment of the present invention as have been described hereinabove, the track or locus G is synthesized from the lifting operation and the lowering operation of the arm support unit 5, the forward and rearward movement of the coating arm 6 and the vertically tilting movement of the coating gun 7.

In this embodiment, the radius R of the curved track or locus G of the coating or spraying gun 7 was 1,500 mm, the length L of the arc was 800 mm for each of the upper side section HU and the lower side section HL, the period of time required for one pass was 1.1 second, and the relative speed was 4.09 meters per minute.

Further, in this embodiment, the longitudinal length Lu of the upper side section HU of the body B is 2.4 meters long and the longitudinal length La of the lower side section HL thereof is 5.1 meters long. From these values and the relative speed Vr, the period of time required for coating one body is computed to give 1.83 minutes. Further, the amount of the paint to be sprayed was 4.50 A.

Second Variant of Coating Method

In FIGS. 9 and 10, the upper side section HU of the side portion of the body B composed mainly of a pillar structure is coated in substantially the same manner as in the lower side section HL by vertically reciprocating the coating gun 7.

It can be noted, however, that by mounting the coating gun 7 to the coating arm in such a manner that the coating gun 7 can be directed to various directions so as to be rotatable about the longitudinal axis of the lateral driving shaft Sy of the coating machine 4 of the coating apparatus 1, the coating gun 7 can be so arranged as to carry out a so-called robot operation along and parallel to the pillar section of the body B and to thereby improve the coating for the pillar section with high efficiency when the upper side section HU is to be coated. In this case, the way of dividing the range or area of the member to be coated and the order of coating the divided sections or blocks are substantially the same as shown in FIGS. 9 and 10.

Figure 11:
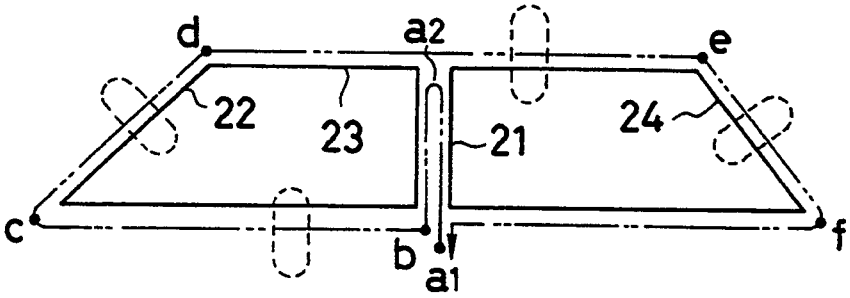
FIG. 11 is a schematic representation showing an appropriate curve of the pillar section at the upper half section of the body and a track or locus of the coating gun.
Figure 12:
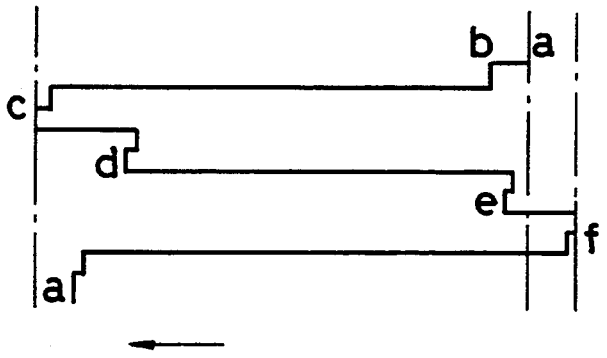
FIG. 12 is a schematic representation showing an example of a pattern of the movement of the coating gun in the direction of conveyance of the body when the pillar section is to be coated.

FIGS. 11 and 12 show an example of the track or locus of the coating or spraying gun 7 and a pattern of movement of the coating gun 7 in the direction of conveyance of the body when the coating gun 7 was moved in a robot-like manner along and parallel to the pillar portion of the upper side section of the body. In this embodiment, the coating gun 7 moved and entered into the coating sections of the upper side section HU is first located in the lowermost end position al of a center pillar 21, followed by the upward movement to a position a2 along the center pillar 21 and then the downward movement to the lower end side b of the center pillar 21.

Thereafter, the coating gun 7 is moved forward to a point c and continued to move obliquely rearward along a front pillar section from the point c toward a point d. From the point d, the coating gun 7 is then moved along a roof rail to a point e from which it is moved in an obliquely rearward direction along a rear pillar section toward a point f. After it reached the point f, the coating gun 7 makes a turn and continues to move along the center pillar section to the lowermost end point al from which it started moving and coating.

During the movement of the coating gun 7 along the pillar, the coating gun 7 is controlled to form a rectangularly spraying pattern of a paint in such a manner that the longitudinal dimension of the pattern is always perpendicular to the pillar sections, as indicated by the broken line in FIG. 11. If the width of the pillar section is smaller to a sufficient extent than the longitudinal dimension of the spraying pattern from the coating gun 7, the pillar section to be coated can be covered with the spraying pattern, thereby enabling a coating with a satisfactorily thick film thickness to be formed on the pillar section by only one coating operation.

In this case, the coating or spraying gun 7 is moved in such a vertically reciprocating manner as in the previous embodiments to coat the divided subsections or blocks H1 and H2 of the lower side section HL.

In place of the coating in that order as described hereinabove, the coating gun 7 may be arranged to move in this order: b → a2 → d → al → a2 → e → f → al.

More specifically, for example, the total distance of movement of the coating gun 7 along and parallel to the pillar sections by such a robot operation reaches approximately 5,000 mm and the position or posture of the coating gun 7 is changed seven times in one coating cycle. The period of time required for changing the position or posture of the coating gun 7 is for 0.3 second, and the tip-end speed Vg of the coating gun 7 during the robot operation is restricted to 20 meters per second.

Hence, the period of time required for coating the upper half side section or block HU is for 17.1 seconds and for coating one full body is for 1.53 minutes.

In this case, the amount of the paint to be sprayed for coating the upper half side section or block HU is represented by the following formula:

$$Q = Vg \times W \times A$$

where

W is the width of a pattern of a coat; and

A is a constant.

In this embodiment, when the pattern width W is set to 300 mm, the amount of the paint Q in this instance becomes 6.0 A.

A description will now be made on evaluation of the first variant as shown in FIG. 9 and the second variant as shown in FIG. 11, compared with coating processes where no tracking operation of the coating gun is implemented.

In Comparative Examples 1, 2 and 3, the vertically reciprocating stroke of the coating gun is set so as to be adapted to the middle portion (the compartment side section) having the longest vertical length and it is moved vertically without variable control. For the region before and behind the middle portion (yet above the front fender portion and the rear fender portion) where no coating is required, the spraying is partially ceased while continuing the stroke operation only, thereby coating the entire area of the side portion of the body. In Comparative Example 1, the tip-end speed of the coating or spraying gun, the pass pitch, and the amount of the paint to be sprayed are set to substantially the same as in the first and second variants. In Comparative Example 2, the pass pitch and the period of time required for coating one body are set in substantially the same manner as in the variants; in Comparative Example 3, the tip-end speed and the period of time for coating one full body are set to substantially the same as in the variants.

In each of the Comparative Examples, the length of a vertical stroke of the coating gun is set to 730 mm.

In Comparative Example 4, the vertically reciprocating strokes of the coating or spraying gun is set so as to be adapted to the lower half side section HL of the body; the coating is carried out without variable control by vertically reciprocating the coating gun-only for coating the lower half side section HL, without the coating for the upper half side section HU. In this embodiment, the length of the vertical stroke is set to 1,200 mm and the pass pitch is set in substantially the same manner as in the first and second variants.

The features of the coating processes, the settings of various conditions and the evaluation results are shown in Table 3 below.

TABLE 3

| No. of Example | Features of Coating Process | Tip End Speed (m/min) | Pass Pitch (mm) | Amount of Paint (× A) | Time (min) | Evaluation Items A | B | C | D | E |
|---|---|---|---|---|---|---|---|---|---|---|
| Variant 1 | Vertically Divided | 60 | 75 | 4.50 | 1.83 | ○ | ○ | ○ | ○ | ○ |
| Variant 2 | Vertically Divided + Robot Operation | | | | 1.53 | ○ | ○ | ○ | ○ | ○ |
| Comp. Exp. 1 | Overall Coating | 60 | 75 | 4.50 | 2.31 | ○ | ○ | ○ | ○ | X |
| Comp. Exp. 2 | at Gun Stroke | 78.6 | | 5.88 | 1.84 | ○ | X | ○ | X | ○ |
| Comp. Exp. 3 | Length = 1730 mm | 60 | 94 | | | ○ | ○ | X | X | ○ |
| Comp. Exp. 4 | Partial Coating | 54 | 75 | 4.05 | 1.53 | X | ○ | ○ | ○ | ○ |

In the Table 3 above, when the evaluation results were satisfactory, the evaluation items are indicated by a circle (O); when the evaluation results were not satisfactory, the evaluation items are indicated by an X-mark (x). The evaluation items referred to above are the same as in Table 2 above.

As have been described hereinabove, the entire side area of the body is divided into subsections in the vertical direction in which the coating or spraying gun is vertically reciprocating; the lower half side section HL is further divided into forward and rearward subsections H1 and H2. The coating is implemented first on the forward lower side section H1, then on the upper half side section HU, and finally on the rearward lower side section H2, thereby completing the coating of the entire side sections without useless movement of the coating gun.

It can be further noted that, as the coating or spraying gun 7 can be tracked on the upper and lower half sections HU and HL by variable control in such a manner as following the curved shapes at the coating sites of the member to be coated, only one coating or spraying gun 7 can coat the entire coating area of the member with high efficiency, while maintaining a constant coat thickness over the entire coating region.

In the aforesaid embodiments, the side portion of the body to be coated is divided into three sections for coating the side portion thereof. It should be noted, however, that the way of dividing the side portion is not restricted to this mode and the side portion may be divided into various modes.

Figure 13:
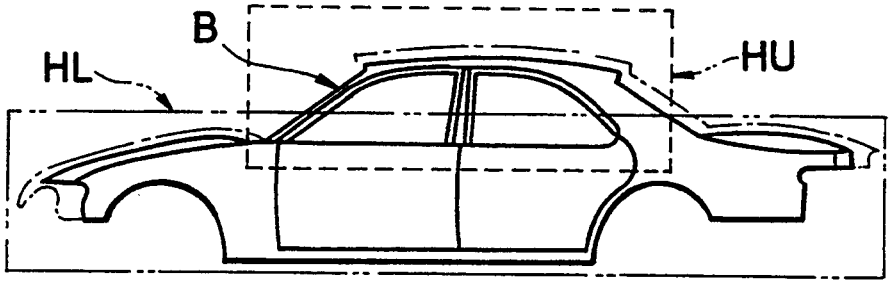
FIG. 13 is a side view showing another example of the coating sections or blocks of the side portion of the body.

For example, as shown in FIG. 13, the side portion may be divided into two sections, upper and lower half sections HU and HL. In this case, the lower half section HL may be first coated and the upper half section HU may then be coated.

Figure 14:
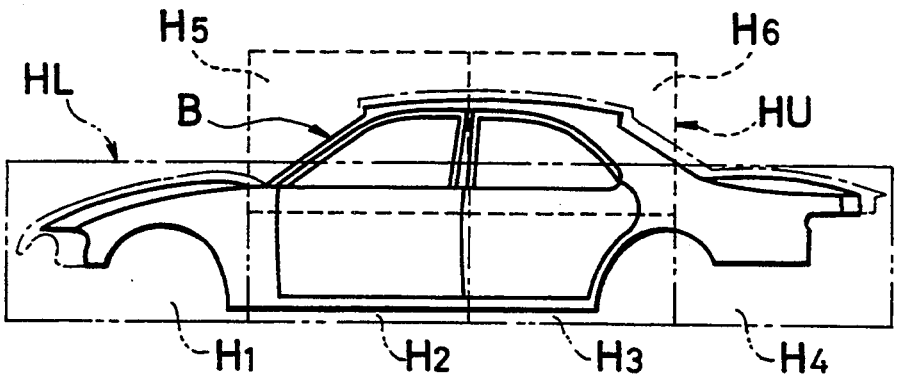
FIG. 14 is a side view showing a further example of the coating sections or blocks of the side portion of the body.

In addition, as shown in FIG. 14, for example, the side portion of the body may be divided in upper and lower half side sections HU and HL; the upper half side section HU is then divided into two forward and rearward subsections H5 and H6; the lower half side section HL is divided longitudinally into four subsections H1, H2, H3 and H4. In this case, the subsections may be coated in this order: for example, H1 → H2 → H5 → H3 → H6 → H4 or H1 → H5 → H2 → H6 → H3 → H4.

The division of the coating region can serve as shortening the amount of tracking for the coating or spraying gun during its movement from one coating section or block to another coating section or block, thereby making the coating system more compact and saving a space for the coating system.

As have been described hereinabove, the aforesaid embodiments according to the present invention show the cases where the coating is performed on the side portion of the body of the automotive vehicle; however, it should be noted that the coating system and the coating method according to the present invention can be applied to all members to be coated, the coating region of which can be divided into sections in the direction in which the coating or spraying gun is reciprocating.

The present invention is not intended in any manner to be limited to the embodiments as described hereinabove, and it is to be understood that any variations or modifications made so as not to deviate from the basic concept of the present invention are interpreted as being encompassed within the spirit of the present invention.

What is claimed is:

1. A coating method for coating a member being conveyed with a coating gun arranged so as to reciprocate in a first direction different from a direction of conveyance of the member to be coated, comprising:
coating said member by altering a reciprocating stroke of said coating gun in accordance with a length of the member extending in said first direction;
wherein said coating gun is so disposed as to reciprocate in said first direction and as to be movable back and forth in said direction of conveyance, and
said coating gun coats said member at a varying speed in said direction of conveyance, said speed varying in accordance with a length of said member in said first direction.

2. A coating method as claimed in claim 1, wherein said speed of said coating gun is altered so as to make a pass pitch of a coat pattern constant.

3. A coating method as claimed in claim 2, wherein said coating gun is arranged such that its tip has a substantially constant speed during coating.

4. A coating method as claimed in claim 2, wherein said coating gun is arranged to spray a paint in a constant amount during coating.

5. A coating method as claimed in claim 2, wherein:
said gun is arranged such that its tip has a substantially constant speed during coating; and
said coating gun is arranged to spray a paint in a constant amount during coating.

6. A coating method as claimed in claim 1, wherein said member is conveyed at a substantially constant speed.

7. A coating method as claimed in claim 1, wherein:
said coating gun is moved in said reciprocating stroke which is longer than the length of said member in said first direction;
wherein a marginal section is provided for said coating gun in said first direction in a region outside of the member.

8. A coating method as claimed in claim 1, wherein:
said member to be coated is a body of an automotive vehicle;
said direction of conveyance is to a longitudinal direction of said body;
said reciprocating direction of the coating gun is a vertical direction of said body; and
said body is coated with said coating gun.

9. A coating method as claimed in claim 8, wherein:
a side portion of said body is divided at least into a front fender section, a rear fender section, and a middle section interposed between said front and rear fender sections; and
said reciprocating stroke of said coating gun is set to be variable at each section.

10. A coating method as claimed in claim 1, wherein said reciprocating direction is set to be perpendicular to said direction of conveyance.

11. A coating method as claimed in claim 1, wherein:
a coating region of said member to be coated is divided into plural sections or blocks in the reciprocating direction of said coating gun; and
said reciprocating stroke of said coating gun is variable.

12. A coating method as claimed in claim 11, wherein said coating region is further divided into plural sections or blocks in said direction of conveyance.

13. A coating method as claimed in claim 11, wherein:
said coating gun is set for its reciprocating track or locus to become variable; and
said reciprocating track or locus of said coating gun is altered in accordance with a radius of curvature for each of said plural sections or blocks.

14. A coating method as claimed in claim 13, wherein said coating gun moves laterally in said direction of conveyance after coating one of said plural sections or blocks and then another section or block is coated by said coating gun.

15. A coating method as claimed in claim 13, wherein:
a coating region of said member to be coated is further divided into plural sections or blocks in said direction of conveyance; and
one section or block is coated after another section or block has been coated.

16. A coating method as claimed in claim 15, wherein:
said member to be coated is a body of an automotive vehicle;
said direction of conveyance is a longitudinal direction of said body;
said reciprocating direction of the coating gun is a vertical direction of said body;
said body is coated on its side portion with said coating gun; and
said coating region of its side portion is divided into plural sections or blocks.

17. A coating method as claimed in claim 16, wherein said coating sections or blocks comprise at least a forward lower section, a rearward lower section, and an upper section of the body.

18. A coating method as claimed in claim 13, wherein said reciprocating track or locus is altered to keep constant a distance between said coating gun and said member to be coated.

19. A coating method for coating a body of an automotive vehicle being conveyed with a coating gun arranged so as to reciprocate in a first direction which is a vertical direction of said body, said body being conveyed in a direction of conveyance longitudinal of the body to be coated, comprising:
coating the side of said body by altering a reciprocating stroke of said coating gun in accordance with a length of the member extending in said first direction;
wherein said coating gun is so disposed as to reciprocate in said first direction and as to be movable back and forth in said direction of conveyance;
wherein said body is conveyed in the direction of conveyance;

a coating region of said member to be coated is divided into plural sections or blocks in the reciprocating direction of said coating gun and in said direction of conveyance; and said reciprocating stroke of said coating gun is variable by means of varying its reciprocating track or locus in accordance with a radius of curvature for each of said plural sections or blocks;

said coating gun being positioned for first coating said forward lower section of said body;

said coating gun starts coating said forward lower section;

said coating gun is moved to position said coating gun for coating said upper section of said body;

said coating gun then starts coating said upper section of the body;

said coating gun is moved to position said coating gun for coating said rearward lower section of said body; and said coating gun then starts coating said rearward lower section of the body.

20. A coating method for coating a body of an automotive vehicle being conveyed with a coating gun arranged so as to reciprocate in a first direction which is a vertical direction of said body, said body being conveyed in a direction of conveyance longitudinal of the body to be coated, comprising:

coating the side of said body by altering a reciprocating stroke of said coating gun in accordance with a length of the member extending in said first direction;

wherein said coating gun is so disposed as to reciprocate in said first direction and as to be movable back and forth in said direction of conveyance;

a coating region of said member to be coated is divided into plural sections or blocks in the reciprocating direction of said coating gun and in said direction of conveyance; and said reciprocating stroke of said coating gun is variable by means of varying its reciprocating track or locus in accordance with a radius of curvature for each of said plural sections or blocks;

and wherein one coating section or block out of said plural sections or blocks contains a pillar section located at an upper portion of said body; and said pillar section is coated while moving said coating gun along and parallel to said pillar section in such a state that a length of said reciprocating stroke of said coating gun is set in accordance with a vertical length of said pillar section.

21. A coating method as claimed in claim 20, wherein:

said coating gun sprays a paint in a substantially rectangular pattern; and said pillar section is coated with said paint from said coating gun such that a longitudinal dimension of said rectangular pattern is oriented substantially perpendicularly to a length of said pillar section.

22. A coating method for coating a body of an automotive vehicle being conveyed with a coating gun arranged so as to reciprocate in a first direction which is a vertical direction of said body, said body being conveyed in a direction of conveyance longitudinal of the body to be coated, comprising:

coating the side of said body by altering a reciprocating stroke of said coating gun in accordance with a length of the member extending in said first direction;

wherein said coating gun is so disposed as to reciprocate in said first direction and as to be movable back and forth in said direction of conveyance;

a coating region of said member to be coated is divided into plural sections or blocks in the reciprocating direction of said coating gun and in said direction of conveyance; and said reciprocating stroke of said coating gun is variable by means of varying its reciprocating track or locus in accordance with a radius curvature for each of said plural sections or blocks;

wherein said coating gun is moved along a shape of said body in a manner different from reciprocating movement in at least a portion of said plural sections or blocks.

23. A coating method as claimed in claim 22, wherein:

said member to be coated is a body of an automotive vehicle;

said coating gun is arranged to coat a side portion of said body; and said portion of the plural sections or blocks contains a pillar section of said body and said coating gun is arranged to move along or parallel to a shape of said pillar section.

24. A coating method as claimed in claim 23, wherein:

said coating gun sprays a paint in a rectangular pattern; and said pillar section is coated with said paint from said coating gun such that a longitudinal dimension of said rectangular pattern is oriented substantially perpendicularly to a length of said pillar section.

25. A coating method as claimed in claim 23, wherein:

said plural coating sections or blocks comprise a first section or block and a second section or block;

said first section contains said front fender section, rear fender section and middle section interposed between said front and rear fender sections; and said second section comprises a upper middle section containing said pillar section.

26. A coating method as claimed in claim 23, wherein:

said plural coating sections or blocks comprise six sections or blocks a first section or block comprising said front fender section;

a second section or block comprising a forward lower section of said middle section;

a third section or block comprising a rearward lower section of said middle section;

a fourth section or block comprising said rear fender section;

a fifth section or block comprising a forward upper section of said middle section, containing a front pillar section; and a sixth section or block comprising a rearward upper section of said middle section, containing a rear pillar section.

27. A coating method for coating a member being conveyed with a coating gun arranged so as to reciprocate in a first direction different from a direction of conveyance of the member to be coated, comprising:

coating said member by altering a reciprocating stroke of said coating gun in accordance with a length of the member extending in said first direction;

wherein said coating gun is so disposed as to reciprocate in said first direction and as to be movable back and forth in said direction of conveyance;

said coating gun coats said member at a varying speed in the direction of conveyance of the member, said speed varying in accordance with a length of said member in said first direction; and the speed of said coating gun is altered so as to make a pass pitch of a coat pattern constant.

28. A coating method as claimed in claim 27, wherein:

said member to be coated is a body of an automotive vehicle;

said direction of conveyance is a longitudinal direction of said body;

said reciprocating direction of the coating gun is a vertical direction of said body; and said body is coated with said coating gun, a side portion of said body being divided into at least a front fender section, a rear fender section and a middle compartment section interposed between said front and rear fender sections and the reciprocating stroke of said coating gun being set to be variable at each of the front fender section, the rear fender section and the middle compartment section so that the speed of the coating gun is less in the middle compartment section than in the front and rear fender sections and the stroke of the coating gun is greater in the middle compartment section than in the front and rear fender sections.

29. A coating method as claimed in claim 28, wherein said coating gun is arranged such that its tip has a substantially constant speed during coating of each section or block and said coating gun is arranged to spray paint in a constant amount during coating; and wherein said body is conveyed at a substantially constant speed.

30. A coating system comprising:

a main body of a coating apparatus disposed so as to be movable back and forth in a direction of conveyance of a member to be coated;

a coating gun mounted to said main body so as to reciprocate in a first direction different from said direction of conveyance; and control means for controlling a reciprocating stroke of said coating gun and a speed of moving said main body back and forth so as to be variable in accordance with a length of said member in said first direction.

31. A coating system comprising:

a main body of a coating apparatus disposed so as to be movable back and forth in a direction of conveyance of a member to be coated;

a coating gun mounted to said main body so as to reciprocate in a first direction different from said direction of conveyance; and first control means for controlling a reciprocating track or locus of said coating gun so as to be variable in accordance with each of sections or blocks divided from a total coating region of said member at least in said first direction; and second control means for controlling said coating gun so as to be transferrable from one coating section or block to another.

32. A coating system comprising:

a main body of a coating apparatus disposed so as to be movable back and forth in a direction of conveyance of a member to be coated;

a coating gun mounted to said main body so as to reciprocate in a first direction different from said direction of conveyance and to be movable along a shape of a said of said member to be coated;

first control means for controlling a reciprocating track or locus of said coating gun so as to be variable in accordance with each of sections or blocks divided from a total coating region of said member at least in said first direction; and second control means for controlling said coating gun so as to be transferrable from one coating section or block to another.

* * * * *